US006995366B2

(12) United States Patent
Franzen

(10) Patent No.: US 6,995,366 B2
(45) Date of Patent: Feb. 7, 2006

(54) ION FRAGMENTATION BY ELECTRON CAPTURE IN LINEAR RF ION TRAPS

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 10/861,232

(22) Filed: Jun. 4, 2004

(65) Prior Publication Data

US 2005/0017167 A1 Jan. 27, 2005

(30) Foreign Application Priority Data

Jun. 5, 2003 (DE) ..... 103 25 579

(51) Int. Cl.
*H01J 39/34* (2006.01)

(52) U.S. Cl. ..... 250/292; 250/293

(58) Field of Classification Search ..... 250/292, 250/293, 290

See application file for complete search history.

(56) References Cited

U.S. PATENT DOCUMENTS

| | | | | |
|---|---|---|---|---|
| 5,420,425 | A | 5/1995 | Bier et al. | |
| 5,572,035 | A | 11/1996 | Franzen | |
| 6,653,622 | B2 * | 11/2003 | Franzen | 250/282 |
| 6,800,851 | B1 * | 10/2004 | Zubarev et al. | 250/292 |
| 2002/0092980 | A1 * | 7/2002 | Park | 250/288 |
| 2004/0155180 | A1 * | 8/2004 | Zubarev | 250/281 |

FOREIGN PATENT DOCUMENTS

| | | |
|---|---|---|
| DE | 1 698 216 | 11/1971 |
| DE | 100 58 706 C1 | 11/1971 |
| GB | 2 372 877 A | 9/2002 |
| GB | 0412405.3 | 10/2004 |
| WO | WO 03/102508 A1 | 12/2003 |
| WO | WO 03/102545 A2 | 12/2003 |

OTHER PUBLICATIONS

Hager, James W., "A New Linear Ion Trap Mass Spectrometer", Rapid Communications in Mass Spectrometry, pp. 512-526.

* cited by examiner

*Primary Examiner*—Kiet T. Nguyen

(57) ABSTRACT

The invention relates to a method and device for the fragmentation of macromolecules in linear quadrupole RF ion traps according to Wolfgang Paul. The invention consists in fragmenting the ions by the capture of low energy electrons (ECD), injected into the linear RF ion trap. One way of doing this is to inject low energy electrons through the gap between the pole rods. Another possibility is to inject the electrons through an opening in one of the pole rods carrying a RF voltage, the electron source being kept at the highest positive potential which is achieved on the center axis of the ion trap during the RF period. Both methods can be improved by pulse-shaped RF voltages, offering longer periods for electron capture. The electron beam can be guided by a magnetic field.

10 Claims, 5 Drawing Sheets

ION FRAGMENTATION BY ELECTRON CAPTURE IN LINEAR RF ION TRAPS

FIELD OF THE INVENTION

The invention relates to a method and device for the fragmentation of macromolecules in linear RF ion traps according to Wolfgang Paul.

BACKGROUND OF THE INVENTION

Ion traps according to Paul usually comprise a ring electrode and two end cap electrodes, the ring electrode usually being supplied with the storage RF voltage. Quadrupole filters with four pole rods according to Paul can also be used as ion traps. In this case diaphragms with ion-repelling potentials at both ends of the rod system are used to trap the ions inside the system. These so-called "linear quadrupole RF ion traps" are easier to fill with ions and can be filled with more ions than the "three-dimensional ion traps." In the interior of the ion trap, ions can be stored in the quadrupole RF field. In a more general sense, ions also may be trapped in linear RF ion traps with more rods, such as hexapole or octopole rod systems, with apertured lens systems at both ends. In U.S. Pat. No. 5,572,035 (J. Franzen), lengthy ion guides made from stacked rings or from a double helix have been introduced. These ion guides can be used as linear RF ion traps, too. The designation "linear RF ion traps" shall here be used for all types of lengthy ion traps, whether rod systems like quadrupole, hexapole or octopole systems or whether such double helix or stacked ring systems.

With linear quadrupole RF ion traps, ions can be mass selectively ejected from these ion traps; the traps can thus being used as mass spectrometers. This is possible in two different ways—either radially through slits in one of the extended electrodes (U.S. Pat. No. 5,420,425, M. E. Bier and J. E. Syka, corresponding to EP 0 684 628 A1), or axially by means of coupling processes in the inhomogeneous end field of the rod system ("A new linear ion trap mass spectrometer", J. W. Hager, Rapid Commun. Mass Spectrom. 2002, 16, 512–526). In both cases, one obtains a mass spectrometer if the ions mass selectively ejected are measured using a detection unit, for example a secondary-electron multiplier, and if the measurement data then are processed into a mass spectrum. The RF voltage on the four rods of the linear quadrupole mass spectrometer is usually high; for customary quadrupole mass spectrometers it is between 15 and 30 kilovolts (peak-to-peak). The frequency is around one megahertz. In the interior, a predominantly quadrupole field is created which oscillates with the RF voltage and drives the ions above a threshold mass to the center axis, causing these ions to execute so-called secular oscillations in this field.

Any linear ion trap is usually operated with a two-phase RF voltage, the two phases being applied alternately to the pole rods, to the helices, or to the rings in turn. An RF field is generated in the interior. On the axis of the linear trap system there is then no RF potential with respect to the ground potential of the mass spectrometer. The linear RF ion traps made from usual hexapole, octopole, double helix or stacked ring ion guides have usually much smaller inner diameters and do usually not need as high RF voltages as quadrupole systems used as mass spectrometers. Some hundred volts are sufficient with frequencies of some megahertz. These systems are simply operated by direct voltage output from MOSFET or similar devices, not using high gain transformers, exactly tuned to the capacity of the RF ion trap.

The RF voltage at the electrodes of the linear traps creates a widely inhomogeneous RF field inside the linear trap, effectively driving the ions back to the central axis of the trap, making the ions oscillate around or through the axis. A damping gas is regularly applied to damp the oscillations; the ions then gather in the axis of the linear RF ion trap. The restoring forces in the ion trap are sometimes described by a so-called pseudo-potential, which is determined by a temporal averaging of the forces of the real potential. For linear traps consisting of rods, there is a saddle point of the oscillating real potential in the center axis which decreases quadratically, depending on the phase of the RF voltage, from the saddle point down toward every second rod electrode, and increases quadratically up toward the other rod electrodes. The saddle point itself shows usually a DC potential with respect to the ground potential, as already described.

Quadrupole ion trap mass spectrometers have characteristics which make them of interest for many types of analyses. In particular, they can be used to isolate and fragment selected types of ion (so-called parent ions) in the ion trap. The spectra of these fragment ions are called "fragment ion spectra" or "daughter ion spectra" of the parent ions in question. It is also possible to measure "granddaughter ion spectra" as fragment ion spectra of selected daughter ions. Until now, the ions have been predominantly fragmented by a multitude of collisions with a collision gas, the oscillations of the ions to be fragmented being excited by an added dipole alternating field in such a way that the ions in the collisions can collect energy, a step which ultimately leads to the decay of the ions.

In other mass spectrometers using linear quadrupole systems, which are designed as so-called triple quadrupole mass spectrometers ("triple quads"), the daughter ions are generated by selecting the parent ions in an initial quadrupole mass filter and by fragmenting the parent ions to daughter ions by injecting them into a second quadrupole filter which is filled with collision gas; only then are they brought into the analyzing third linear quadrupole system.

The ions ultimately fragmented for the measurement of a daughter ion mass spectrum can be either generated in the interior of the linear ion trap or be introduced from outside. A collision gas in the linear ion trap ensures that the ion oscillations initially present are decelerated in the quadrupole RF field; the ions then collect as a small cloud on the center axis of the ion trap. The diameter of the string-shaped ion cloud in normal linear ion traps is around half a millimeter; it is determined by an equilibrium between the centering effect of the RF field (the restoring force of the pseudo-potential) and the repulsive coulomb forces between the ions. The internal dimensions of the RF ion trap are usually characterized by a separation of opposing rods of between three and twelve millimeters approximately.

A popular type of ionization of large biomolecules is the electrospray method (ESI=electro spray ionization), which ionizes ions at atmospheric pressure outside the mass spectrometer. These ions are then brought via inlet systems of a known type into the vacuum of the mass spectrometer and from there, mostly using intermediate RF ion guides, into a mass spectrometer.

This type of ionization generates practically no fragment ions, the ions being essentially those of the molecule. With electrosprays, multiply charged ions of the molecules do frequently occur, however. As a result of the lack of almost any fragment ion during the ionization process, the information from the mass spectrum is limited to the molecular weight; there is no information about internal molecular structures which can be used for the further identification of the substances present. This information can only be obtained by scanning fragment ion spectra (daughter ion spectra).

Recently, a method for the fragmentation of biomolecules, mainly peptides and proteins, has been developed for use in ion cyclotron resonance mass spectrometry (ICR-MS), also called Fourier transform mass spectrometry (FTMS). Low energy electrons are captured by multiply charged ions, whereby the ionization energy released leads to the fragmentation of the usually chain-shaped molecules. The method has become known as ECD (electron capture dissociation). If the molecules were doubly charged, one of the two fragments created remains as an ion. In this process, the fragmentation follows extremely simple rules (for specialists: there are predominantly c-cleavages and only a few a-cleavages and z-cleavages between the amino acids of a peptide), so that it is very simple to elucidate the structure of the molecule from the fragmentation pattern. In particular, the sequence of amino acids in the peptides or proteins is easy to read from the fragmentation spectrum. The interpretation of these ECD fragment spectra is much simpler than the interpretation of collisionally induced dissociation (CID) spectra.

It is also possible to fragment triply or multiply charged ions in this way, but the method really shines in the case of doubly charged ions. If an electrospray ionization is applied to peptides, the doubly charged ions are also the most prevalent ions, as a rule. Electrospray ionization is a method of ionization which is particularly frequently used for mass spectrometric analysis of biomolecules in RF ion traps and other types of mass spectrometers.

For fragmentation by electron capture, the kinetic energy of the electrons must be very low, below 3 eV, since otherwise there can be no capture. In most cases, one just offers electrons with an energy which lies just above the thermal energy of the electrons. Electrons with about 3 to 30 electron Volts can also be used, they generate "hot ECD" fragment ions. In the extremely strong magnetic fields of Fourier transform mass spectrometers this is very successful, because the electrons simply drift along the magnetic field lines until they reach the cloud of ions.

SUMMARY OF THE INVENTION

The invention proposes the fragmentation of selected, multiply charged ions, provided in a linear RF ion trap, by the capture of low energy electrons injected into the linear RF ion trap. The electrons can be injected in two different ways into the ion cloud inside a linear RF ion trap, such that they arrive with low energy:

The first method injects low energy electrons into the ion trap through the gap between two neighboring pole rods, or between the neighboring helices, or between neighboring rings of the stack, whereby the electrons can penetrate into the ion cloud in zero voltage periods of the RF only. The periods of zero voltage can be enlarged by using an RF voltage consisting of positive and negative pulses with periods of zero voltage in between. Even in relatively short periods of zero voltage, the electrons, which are very fast even at low energies, can reach the ion cloud in the axis of the linear RF ion trap; these electrons are then trapped within the cloud and can be captured by the ions. The electron injection may be guided by a magnetic field from a permanent or electro magnet.

The second method can be used with rod systems only. The method injects the low energy electrons into the ion trap through an opening in one of the RF-carrying pole rods, the electron source being at such a potential that it is equaled or exceeded by the oscillating potential of the center axis of the ion trap for only a short period of time. The electrons intermediately have relatively high kinetic energies, but are decelerated before arriving at the ion cloud. The electrons are generated on the RF potential of the other rods, superimposed by a DC component amounting to half the maximum RF potential (peak-to-peak). The useful period for electron capture here also can be enlarged by using a RF voltage consisting of pulses with flat top voltages. Here again, the electrons may be guided by a magnetic field.

Operated by usual sinusoidal RF voltage, the electrons can reach the center axis, where the string-shaped ion cloud has settled, for only a few nanoseconds in both methods described. In the first injection method through gaps between the electrodes, only the time around the zero crossover can be used; in the second injection method through slits in the rods, the short period around the maximum of the RF voltage may be used. At all other times, the electrons cannot reach the center axis of the ion trap at all. Using flat pulses or pulses with periods of zero voltage instead prolongs the period for electron capture.

With the second injection method, the deceleration of the ions takes place en route from the opening in the pole rod to the center axis, during which time the electrons must climb to the saddle of the potential. The string-shaped ion cloud is gathered at the saddle point of the potential. The saddle potential focuses the electrons onto the ion cloud, while electrons which deviate laterally toward the other pole rods are forced back onto the correct path in the saddle channel again. In the direction of the axis of the rod system (generally called the z-direction) neither focusing nor defocusing of the electron beam takes place at this time. Since the ion cloud extends a long way along the axis, however, no focusing is necessary here.

The invention also concerns linear RF ion traps to carry out the method. The linear ion traps then comprise an electron source positioned outside the RF ion trap in front of the gap between the electrodes or, if consisting of pole rods, in front of the opening in one of the pole rods. Optionally, an RF generator is comprised which can be switched to special types of RF voltages consisting of pulses. Furthermore, magnetic fields can be applied, either by permanent magnets or by electromagnets.

BRIEF DESCRIPTION OF THE DRAWINGS

The above and further advantages of the invention may be better understood by referring to the following description in conjunction with the accompanying drawings in which.

DETAILED DESCRIPTION

Figure 1:
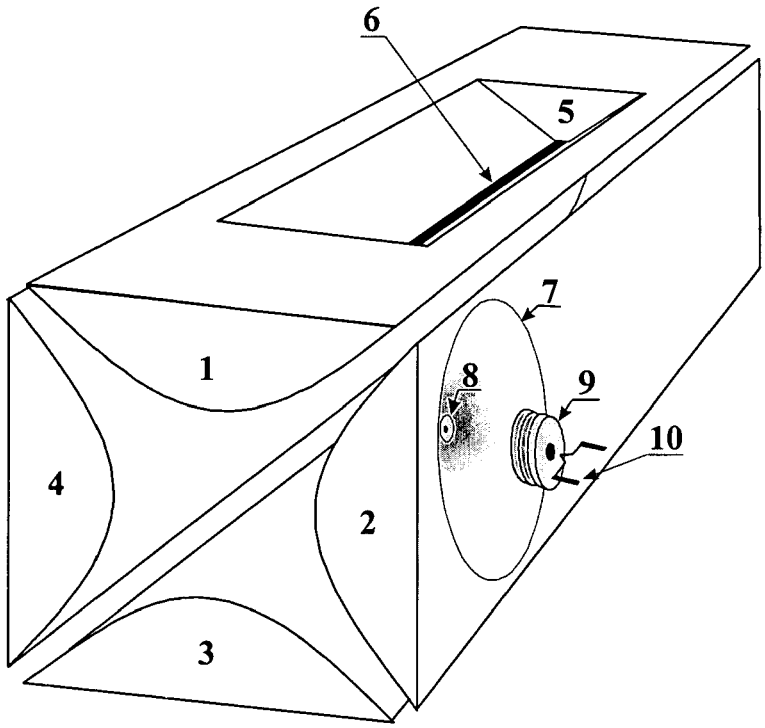
FIG. 1 shows a linear quadrupole RF ion trap for radial mass selective ejection of ions, the ejection taking place through a slit in a pole rod.

One of a set of favorable embodiments of the invention is illustrated in FIG. 1 and shows a linear RF ion trap as part of a linear RF ion trap mass spectrometer for radial mass selective ejection of ions through slit (6) in pole rod (1). FIG. 1 does not show, for reasons of clarity, the front closing diaphragms with ion repelling DC voltages. The linear quadrupole RF ion trap is equipped with an injection device for electrons from a thermionic cathode (10) and with a set of diaphragms (9) for controlling the electron beam. The injection of the electrons occurs in this case through a small opening (8) in the RF-carrying pole rod (2). The injection opening here is located at a point of the linear RF ion trap which is not covered by the ejection slit (6), in order that the small electron injection opening does not disturb the ejection. The diaphragm set (9) serves to switch the electron beam on and off and to focus it onto the small opening (8).

When the electrons are not able to diffuse sufficiently rapidly in the lengthy ion cloud in the axis of the linear RF ion trap, a slit of some length with an electron emitter of some length can be used, instead of hairpin emitter (10) used with the small circular opening (8).

Instead of using a mass spectrometer with radial ejection of the ions, as shown in FIG. 1, the invention can also be used for linear quadrupole RF ion trap mass spectrometers with axial ejection of the ions. Such quadrupole RF ion guides used as mass spectrometers usually have inner diameters between opposing rods of eight to sixteen millimeters. As described in more detail below, in further embodiments of the invention the linear RF ion trap may not by itself be used as a mass spectrometer, instead the daughter ions fragmented inside such a linear RF ion trap are analyzed in a separated mass spectrometer, such as a Fourier transform mass spectrometer (FTMS), a three-dimensional Paul RF ion trap (ITMS), or a time-of-flight mass spectrometer (TOF MS) with orthogonal ion injection. In such cases, the linear RF ion trap may be formed from a usual ion guide with much smaller inner diameter of two to four millimeters only, such as usual hexapole or octopole ion guides, or an RF ion guide using two helical wires or a stack of rings.

The operation of the linear RF ion trap for fragmentation purposes usually uses an electrospray ion source outside the vacuum system of the mass spectrometer for ionization of biomolecules. It will be assumed that a mixture of digest peptides of a relatively large protein is to be analyzed. The ions are guided in the usual way through a capillary and subsequent pressure stages with ion guides into the linear RF ion trap, where they are trapped. An initial mass spectrum provides an overview of the digest peptides. If it is then required to analyze the daughter ion spectrum of one or more peptides to establish their sequence of amino acids, the doubly charged ions of this peptide are isolated by usual means, either in a quadrupole filter before the linear RF ion trap, or within the linear RF ion trap itself, if this linear RF ion trap can be operated as a mass spectrometer. All ions which are not doubly charged ions of the selected peptide are eliminated. The double charge ions can be recognized in the original spectrum from the distance between the isotope lines, which is exactly ½ an atomic mass unit for doubly charged ions.

These doubly charged ions are damped into the center axis of the trap after a short delay of a few milliseconds by the ever-present collision or damping gas. The ions then form an extended, string-shaped cloud of ions of roughly half a millimeter in diameter.

In the device of FIG. 1, the pole rod (2) of the ion trap which is carrying the high voltage is equipped with a small hole (8) of around half a millimeter in diameter in a cavity (7). A hairpin electron emitter (10) with diaphragm-shaped electrodes (9) for extracting the electrons and focusing the beam of electrons is mounted in front of the cavity (7). This electron emitter (10) is at the potential assumed by the saddle point of the trap potential on the center axis at the time of its positive maximum, a potential which is therefore also assumed within the string-shaped ion cloud at this time. This can be achieved either by grounding the rods neighboring the apertured rod, and applying a DC voltage to the electron gun that is about half the peak-to-peak voltage of the RF, or applying a voltage to the electron gun, which is superimposed by the RF voltage of the neighboring rods plus half the peak-to-peak voltage of the RF.

If the electron extraction through the set of diaphragms (9) is switched on, a fine beam of electrons is formed which is focused on the entrance aperture (8) of the pole rod (2) by the electric focusing of the set of diaphragms (9) only at the exact moment in which the electrons have a chance to reach at the ion cloud inside the RF ion trap. The electron beam is driven back by the pole rod (2) as long as the RF potential of the pole rod (2) is more negative than the potential of the electron emitter (10). If, during the course of the RF period, the potential of the pole rod (2) becomes more positive, then the electrons are increasingly accelerated toward the pole rod (2), but for most of the time they are still strongly defocused, a situation brought about by the interplay of the potentials on the set of diaphragms (9) and the cavity (7). The few electrons which arrive at the aperture then pass through the tiny entrance (8) into the ion trap where they encounter an opposing, decelerating potential profile which they cannot completely climb. They are therefore reflected again. Only at the maximum of the potential of the RF period can the electrons penetrate as far as the saddle point on the center axis where the string-shaped ion cloud is located. At this point in time, the focusing of the electron beam onto the small entrance aperture (8) is at its best, so that only now significant numbers of electrons can penetrate into the ion trap. This optimum focusing is adjusted by the potentials on the set of diaphragms (9).

Figure 2:
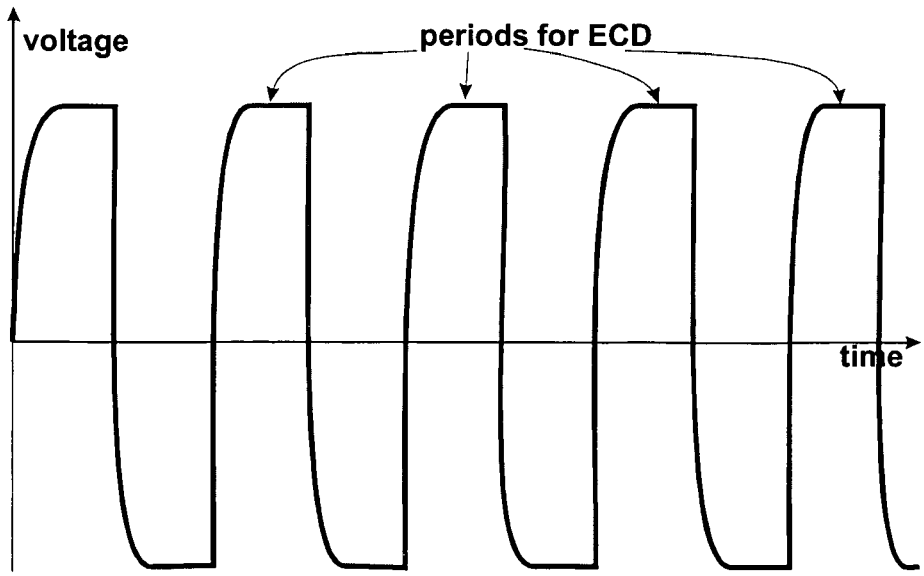
FIG. 2 presents a favorable pulse shape for the RF voltage used for the linear RF ion trap of FIG. 1.

To improve the process of electron capture, the time period for the electrons to arrive at the ion cloud can be enlarged. This can be done by shaping the RF voltage to show pulses with flat voltage tops, as is exhibited in FIG. 2.

Figure 3:
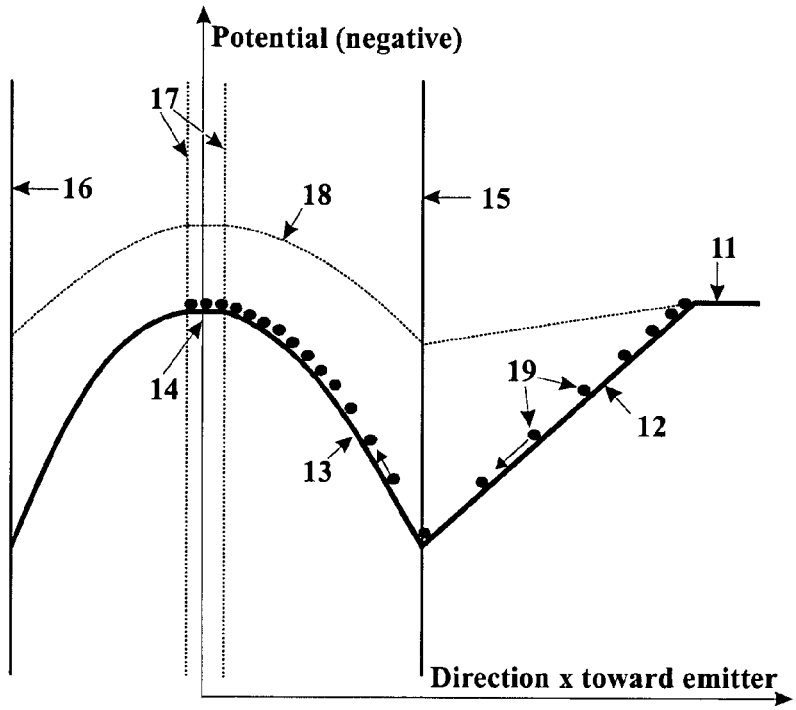
FIG. 3 shows, for the linear quadrupole RF ion trap of FIG. 1, a graphical depiction of the potential profile from the location of the electron source to the location of the string-shaped ion cloud at the time of the voltage maximum of the RF period.

FIG. 3 shows a scheme of the potential profile (11, 12, 13, 14) from the location of the electron source (11 ) across the position (15) of the pole rod to the location of the string-shaped ion cloud (14) at the time of the voltage maximum of the RF period. In FIG. 3, negative potentials point upwards, so that electrons can schematically "roll down" the potentials in the way we normally imagine them to do.

Positions (15) and (16) schematically represent the location of the two opposed pole rods which are carrying the RF voltage in its maximum. The ion cloud (14) is located between the two regional limits (17). The electrons (19) roll first down the potential slope (12) between electron source potential (11) and pole rod potential (15), and are then decelerated on the rising potential slope (13) towards the potential (14) of the ion cloud. This potential profile occurs only during the few nanoseconds of the maximum potential of the high voltage period. The potential profile (18) illustrates a profile in another phase of the RF period. In this phase, the saddle point is too high (too negative) and the electrons cannot climb it.

Example for the case of a grounded pair of rod electrodes: if the fragmentation in the ion trap occurs at an RF voltage of 3 kilovolts peak-to-peak, then the potential on the center axis follows with exactly half this amount. If the RF voltage, applied to the pole rod through which the electrons are injected, oscillates in the potential range −1.5 to +1.5 kilovolts against ground, then the potential of the center axis follows with an oscillation amplitude of −750 to +750 volts. If the electron source is at a DC potential of +750 volts, the electrons can only reach the center axis when the pole rod voltage in the voltage maximum is at +1.5 kilovolts and the potential on the center axis correspondingly at +750 volts. In this case, the electrons are accelerated outside the ion trap from the potential of the electron source (+750 V) to the considerably more positive potential of the pole rod (+1.5 kV), thus receiving an energy of 750 electron-volts. In the interior of the ion trap, the kinetic energy of 750 electron-volts is decelerated to practically zero electron volts again, because the center axis is at the potential of +750 volts. At all other times, the center axis is at a more negative potential, and the negative electrons are repelled.

Figure 4:
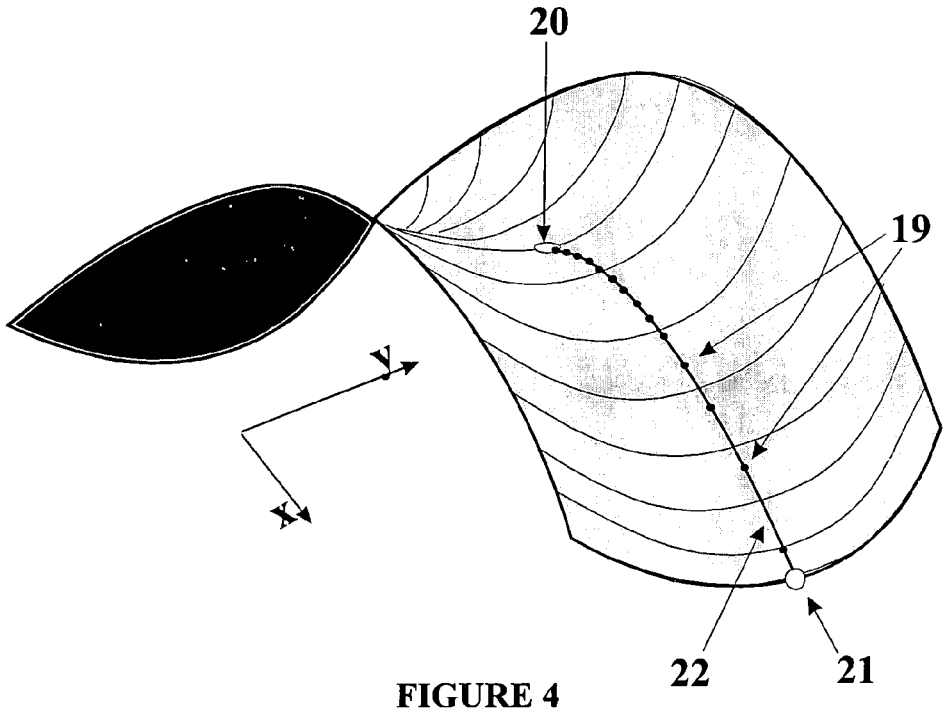
FIG. 4 shows, again for the linear quadrupole RF ion trap of FIG. 1, the potential saddle between the four pole rods (x- and y-direction) at a fixed phase of the RF.

FIG. 4 shows the potential profile, which the electron beam experiences in the interior of the ion trap, above the x-y plane rectangular to the axis of the rod system. The potential profile forms a very favorable potential saddle which the electrons (19) can very easily climb along path (22) to the ion cloud (20) since, in this plane, they are automatically guided by the shape of the saddle. The electrons (19) are injected at point (21). In the z-direction, i.e. along the length of the rod system, there is no focusing, but neither is there any defocusing, so that the electrons always reach the ion cloud.

After climbing the potential saddle, the electrons arrive in the ion cloud having been decelerated to a kinetic energy of practically zero electron volts. They are now initially trapped by the space charge potential of the ion cloud, practically without any trapping losses, before being captured by the individual ions.

In the ion cloud, the electrons, which now possess little energy, are trapped by multiple, statistical deflections of their direction of flight caused by the coulomb field around the individual ions, a process which usually causes them to lose a small amount of kinetic energy each time. For energy reasons, they can no longer leave this ion cloud; they can, however, easily diffuse in the string-shaped cloud in the longitudinal direction through the cloud. They are ultimately trapped by an ion to recombine with an ion charge.

If the string-shaped ion cloud is cooled too much, the ions are lined up without moving on the axis of the rod system, and it is no longer possible for the electrons to diffuse in the longitudinal direction. The electrons must then be injected either through a long slit or through several openings or, in the case of electron injection through a single, small hole, the electrons must be enabled to diffuse. This can occur, for example, by means of a slight dipole excitation of the ions by a weak dipole alternating voltage with a frequency mixture ("white noise") or a weak excitation frequency for the doubly charged ions between the two pole rods, which should be at DC potential according to the above description.

When an electron is caught by an ion, the charge status of the ion is decreased. One ionization site of the ion is neutralized. The doubly charged ion becomes a singly charged ion. This process releases the ionization energy. (More precisely: the ions are predominantly protonated biomolecules. It is therefore the attachment energy of the proton, the so-called proton affinity energy, which is released). The energy released is absorbed in the ion and leads to a very precisely defined spontaneous cleavage between two amino acids, exactly at the site of the neutralized proton, to a so-called c-cleavage as a rule. Other ions of the same type each undergo a cleavage between two other amino acids. Statistically, a mixture of fragment ions is created whose length mirrors the complete chain of the amino acids, or at least a part of this chain. One of the advantages of fragmentation by electron capture is that roughly the same number of all the c-fragments is formed, i.e. they provide a mass spectrum from which the sequence of the amino acids is easily readable.

Figure 9:
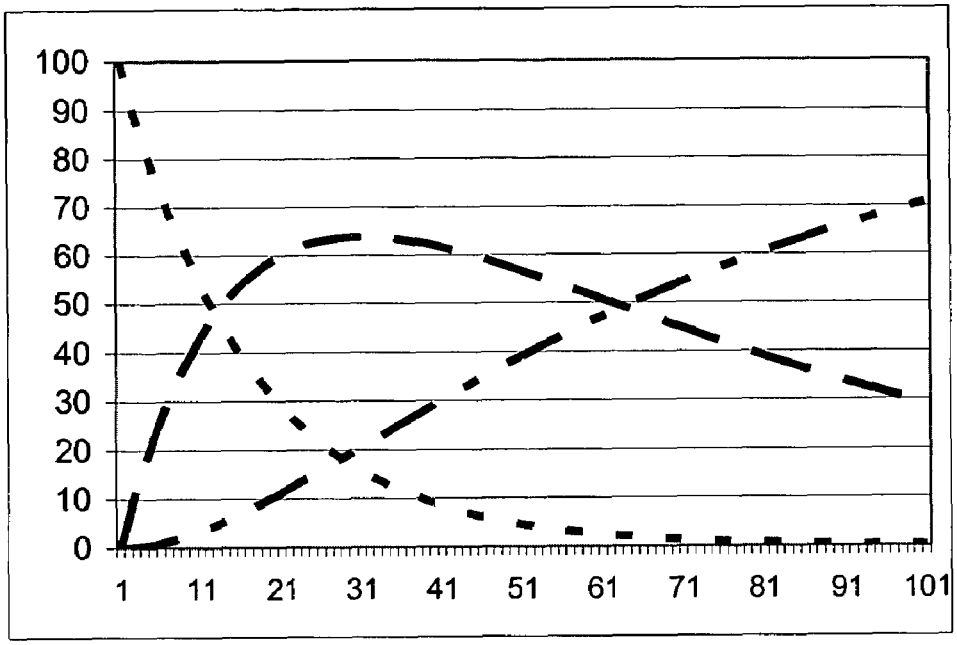
FIG. 9 shows the timing for the decrease of the doubly charged ions (dotted line), the increase of the neutral particles after double discharge (chain-dotted line) and the characteristic of the singly charged ions (dashed line).

The electron beam is switched off as soon as sufficient fragmentation has taken place. FIG. 9 shows how the doubly charged ions decrease and the singly charged ions (fragment ions) increase with time. This process must not be continued for too long since, otherwise, the singly charged fragment ions recombine to form neutral particles. After switching off the electron beam and after a short settling period, the singly charged fragment ions are scanned as a mass spectrum in the usual way. The interpretation of this mass spectrum provides the sequence, or at least a partial sequence, of the amino acids in this peptide.

This method can then be repeated for other peptides in the mixture. This provides for very reliable identification of the protein. It is even possible to determine differences between the protein analyzed and those in protein sequence databases.

Figure 5:
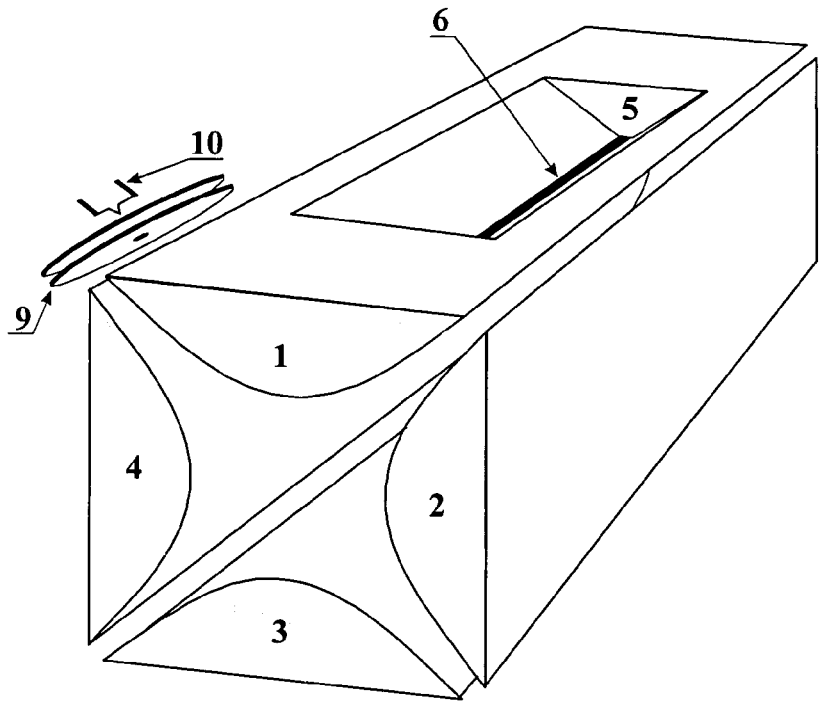
FIG. 5 shows a linear quadrupole RF ion trap having an electron emitter with focusing and control diaphragms for the injection of low energy electrons through the gap between two pole rods.

In FIG. 5, a different arrangement is shown, again with the linear RF ion trap as part of a linear RF ion trap mass spectrometer. The electron beam is now injected from electron emitter (10) with focusing and control diaphragms (9) through the gap between two adjacent rods (1) and (4). Here, the electrons can only penetrate into the ion cloud inside the linear RF ion trap in phase periods of the RF voltage in which the voltage of the four rods crosses zero voltage. These periods are extremely short, but because even electrons of very low kinetic energies are very fast, enough electrons can arrive at the ion cloud in the axis of the linear RF ion trap if the electron current is high enough.

Figure 6:
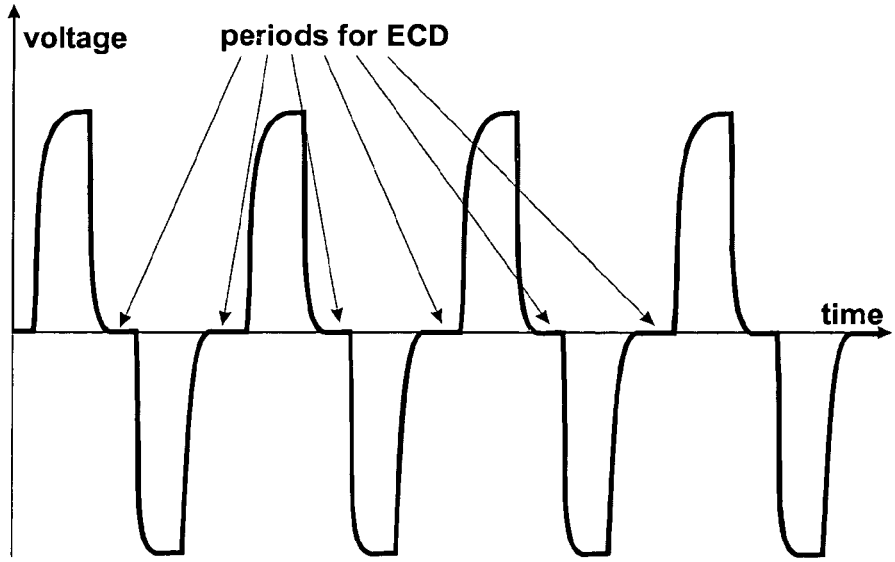
FIG. 6 exhibits a favorable pulse shape for the RF voltage used for the configuration of FIG. 5, with extended zero voltage periods for electron capture between the pulses.

To improve this situation for smaller electron currents, the RF voltage can be shaped to positive and negative pulses, with elongated periods of zero voltage in between the pulses, as shown in FIG. 6.

Figure 7:
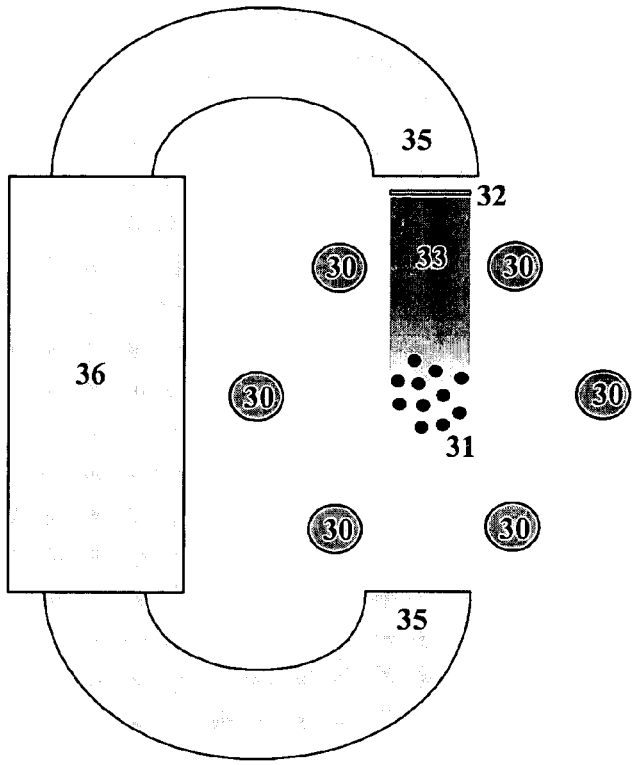
FIG. 7 shows a cross section through a linear hexapole RF ion trap with the pole rods, the ion cloud, the beam of low energy electrons from the ribbon filament injected through the gaps between the pole rods.

As mentioned above, the linear RF ion trap must neither be a quadrupole RF ion trap, nor serve by itself as a mass spectrometer. In FIG. 7, a cross section of a hexapole RF ion trap with six rods (30) is shown. Such a system may be derived from a usual hexapole RF ion guide, the inner diameter between opposing rods being in the order of 3 millimeters only. A beam (33) of electrons are generated by a hot ribbon cathode (32) along the rod system and directed, by a low acceleration voltage at the hot ribbon cathode, into the interior of the hexapole RF ion trap, where the ions are gathered as a cloud (31) in the axis of the trap by a damping gas. The hot ribbon cathode may stretch over a considerable part of the length of the hexapole RF ion trap. The ions can react with the electrons and fragment by the electron capture process. In FIG. 7, the electrons are additionally guided by a magnetic field generated by an (optional) electromagnet with coil (36) and yokes (35). The magnetic guidance may not be necessary at all. The (optional) magnetic field may be switched off when the fragmented ions are guided to the analyzing mass spectrometer.

Again, the periods for the electrons to hit the cloud of ions can be elongated by a pulse-shaped RF voltage according to FIG. 6, showing positive and negative pulses with elongated periods of zero voltage in between the pulses. In the case of this hexapole RF ion trap with its much lower RF voltage, forming of the RF voltage is easy because the RF voltage is usually generated as the direct output of MOSFET (or similar) devices which easily can be controlled to give any shape of pulses. This is in contrast to transformer-generated sinusoidal RF voltages which are usually tuned to high gain and high voltages in a critical manner. Even with an RF frequency of two megahertz, zero voltage periods of about 100 nanoseconds can be achieved.

Figure 8:
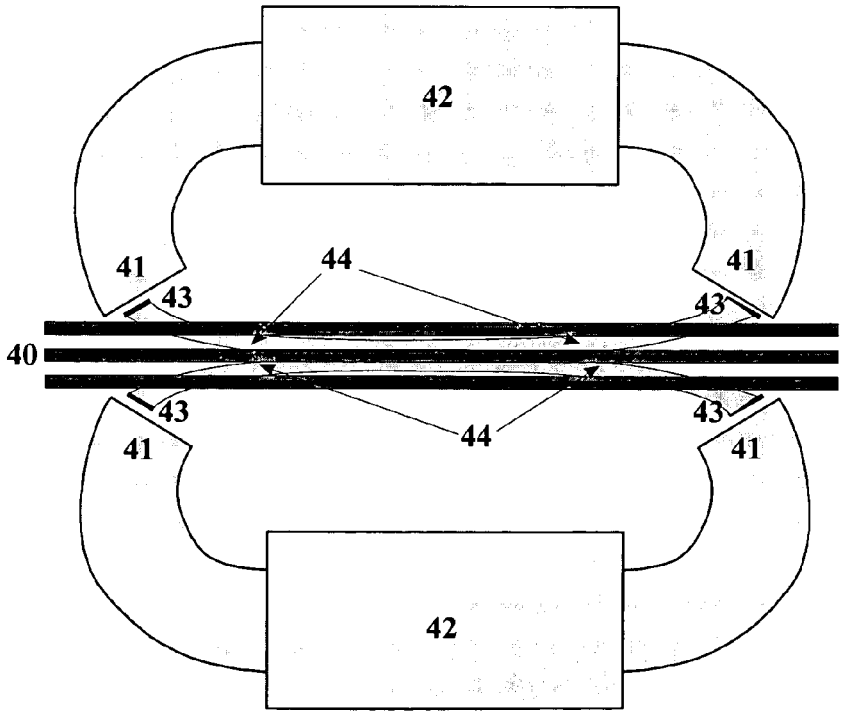
FIG. 8 exhibits a linear hexapole RF ion guide in a different operation mode: the magnetic field generated by the coils and yokes is widely parallel to the rods of the hexapole RF ion trap, and the electron beams emitted from the hot cathodes follow the magnetic field lines into the center of the trap.

In FIG. 8, still another type of electron injection into a linear hexapole RF ion trap is shown. Magnet coils (42) with yokes (41) form an essentially axial magnetic field inside the hexapole RF ion trap, penetrating from the yokes sideways into the interior. The magnetic field is roughly parallel to the rods (40) of the ion trap. Hot cathodes (43) generate electrons in electron beam (44) which follow the magnetic field lines into the center of the hexapole RF ion trap, where they can be captured by the ions gathered.

The fragmentation by electron capture which this invention makes possible possesses a number of advantages that are not immediately apparent:

First advantage: since the storage of the original ions and their fragmentation is now possible with very low q in the Mathieu diagram of the RF field, the secular motion of the ions is very slow. This, in turn, is favorable for electron capture.

Second advantage: by fragmenting with a low RF voltage, all daughter ions down to those with low masses can be stored, because the threshold mass for ion storage is now very low. This was not possible before because, for collision fragmentation, one had to work with a minimum RF voltage otherwise the collision energy would be too low and fragmentation was frequently not possible. Only with very low RF voltages is it possible to scan the complete amino acid fragment spectrum of the c-cleavages from the first amino acid upwards. Example: a large, doubly charged peptide with 20 amino acids has a molecular weight of around 2400 atomic mass units and a specific mass of m/z=1200 mass units per elementary charge. Daughter ions from collision fragmentation can normally be stored only above a threshold mass of 400 mass units per elementary charge (corresponding to roughly three to four amino acids); with ECD, however, storage is now possible, by selecting a very low RF voltage, as from 60 mass units per elementary charge, so that even the smallest single amino acids can be collected.

Third advantage: the generation of the singly charged ions from doubly charged ones and the associated loss of singly charged ions is favorable, as can be seen in FIG. 9 (if the cross-sections for the electron capture do indeed behave as 4:1, which may not be true for all types of ion). If the yield of singly charged ions is approximately 50% of the original number of doubly charged ions, then the doubly charged ions have sunk to approx. 2–3%; they therefore no longer cause interference. Around 47% of the singly charged ions are lost as a result of neutralization; this is quite acceptable. Other types of fragmentation have considerably lower yields.

Fourth advantage: the fragmentation by ECD is very rapid, it only takes a few milliseconds. This saves around 40–50 milliseconds fragmentation and damping time. This means that more spectra can be scanned per unit of time.

The method according to the invention naturally requires that the most favorable potentials of the ion emitter be initially adjusted for each setting of the RF voltage. A calibration curve is created experimentally for this purpose. The optimum parameters for the electron emission current and the duration of the electron beam operation are also determined experimentally.

As the electrons penetrate into the ion trap, ions of the collision gas are, of course, also generated in the ion trap by electron collision. Helium is normally used as the collision gas but other light gases can also be used. The masses of the ions of these gases regularly lie below the storage threshold of the ion trap; the ions leave the ion trap within a very few RF periods, usually within one single period. The generation of damping gas ions is completely avoided, if the injection of electrons through the gaps between the RF electrodes is used and if the electron beam is switched off by the control apertures in other phases of the RF.

For ECD fragmentation, a maximum of around $10^5$ to $10^6$ ions only should be present in the ion cloud since otherwise the diameter of the string-shaped ion cloud becomes too large. For the electron capture fragmentation in the cloud, roughly $3\times10^5$ to $3\times10^6$ electrons are therefore required. The conditions which enable low energy electrons to access the ion cloud prevail only for the short duration of the optimum conditions of the RF phase. The duration amounts to only around 10% of the RF period if pulse-shaped RF voltages are used, i.e. around 100 to 200 nanoseconds. Only approximately ten per cent of the electrons in the electron beam are therefore trapped. This means that approximately $3\times10^7$ electrons have to enter the ion trap volume. If one expects a loss of 99 percent of the ions between the thermionic cathode and the entrance to the ion trap volume, then around $3\times10^9$ electrons must be supplied by the thermionic cathode. If one wants to complete the process in one millisecond, an electron emission current of approximately $3\times10^{12}$ electrons per second is required. This is an electron emission current of around 150 nanoamperes, i.e. extremely low, since, even with a very simple electron source, it is easy to achieve electron emission currents of around 100 microamperes. Even with electron losses higher by a factor of 100, the required electron emission current would be easy to generate.

In the case of fragmentation by means of electron capture on doubly charged ions, the destruction of a number of previously formed, singly charged fragment ions by further electron capture cannot be avoided. FIG. 9 shows estimated curves for the recombination (with fragmentation). The curves in FIG. 9 were calculated on the assumption that the cross-section for the recombination of doubly charged ions is larger by a factor of 4 than the cross-section for the recombination of singly charged ions, an assumption which experience has shown to be valid. This enables a good compromise to be found between remaining doubly charged parent ions, singly charged fragment ions and ions destroyed by being completely discharged. It is, however, necessary to begin with considerably more ions than are required for the fragment ion spectrum ultimately scanned. This must be taken into consideration when both storing and isolating the ions.

A specialist could also think of more complicated potential supplies which have the same effect of supplying the ion cloud in the center only with zero energy electrons, for example by setting the potential of the electron emitter also to an RF voltage. However, all these solutions are more expensive than the solution to the problem suggested above, even though these more complicated solutions should be included in the basic idea of the invention.

What is claimed is:

1. A method for the fragmentation of multiply charged parent ions, comprising the steps of:

(a) providing a linear RF ion trap;

(b) providing an electron source outside the linear RF ion trap;

(c) providing a damping gas inside the linear RF ion trap;

(d) providing in the linear RF ion trap a cloud of parent ions to be fragmented, whereby the ions gather in the axis of the linear RF ion trap; and (e) injecting electrons from the electron source into the ion cloud with a maximum kinetic energy of 30 electron volts at the arrival at the ion cloud, whereby at least a part of the ions are fragmented by reactions with the electrons.

2. The method according to claim 1, wherein the electrons are injected into the linear RF ion trap through gaps between the RF carrying electrodes of the linear RF ion trap, whereby electrons arrive at the ion cloud only in periods around RF phases with zero voltage.

3. The method according to claim 2, wherein the RF voltage consists of positive and negative pulses with extended zero voltage periods between the pulses.

4. The method according to claim 2, wherein the electrons are guided by a magnetic field, generated by at least one permanent magnet or by at least one electromagnet.

5. The method according to claim 1, wherein a linear RF quadrupole ion trap with four rods is used, the electrons are injected through an aperture in one of the rods, and the electron source is at a potential which is a sum of the RF potential of the rods neighboring the apertured rod plus a DC voltage amounting to half the peak-to-peak voltage of the RF voltage of the RF quadrupole ion trap.

6. The method according to claim 5, wherein the RF voltage consists of positive and negative voltage pulses with flat tops.

7. The method according to claim 5, wherein the electrons are guided by a magnetic field, generated by at least one permanent magnet or by at least one electromagnet.

8. A linear RF ion trap comprising:

(a) RF carrying electrodes arranged around the axis of the linear RF ion trap;

(b) an ion source outside the linear RF ion trap with means to transfer ions into the interior of the linear RF ion trap;

(c) a source of damping gas to fill the linear RF ion trap with a preselected pressure of damping gas; and (d) an electron source outside the linear RF ion trap with means to inject the electrons into the linear RF ion trap.

9. The linear RF ion trap according to claim 8, further comprising a generator for an RF voltage consisting of positive or negative pulses with either flat tops or with extended periods of zero voltage in between the pulses.

10. The linear RF ion trap according to claim 8, further comprising a magnet system for the generation of a magnetic field to guide the electrons into the linear RF ion trap.

* * * * *